United States Patent [19]

Tardy

[11] Patent Number: 4,649,951

[45] Date of Patent: Mar. 17, 1987

[54] ASSISTED SLIDE FOR PRESSURE COMPENSATION IN A HYDRAULIC DISTRIBUTOR

[76] Inventor: Maurice Tardy, 20 rue Eugene'-Joly, Saint Etienne, Lorie, France

[21] Appl. No.: 751,189

[22] Filed: Jul. 2, 1985

[30] Foreign Application Priority Data

Jul. 3, 1984 [FR] France ..... 84 10982

[51] Int. Cl.[4] ..... F15B 13/02

[52] U.S. Cl. ..... 137/596; 91/446; 137/501; 137/596.13

[58] Field of Search ..... 137/596.13, 117, 501, 137/596; 91/446

[56] References Cited

U.S. PATENT DOCUMENTS

| | | | |
|---|---|---|---|
| 3,628,424 | 12/1971 | Fruehauf et al. | 137/596.13 X |
| 3,631,890 | 1/1972 | McMillen | 137/596.13 |
| 3,777,773 | 12/1973 | Tolbert | 137/596.13 X |
| 3,878,864 | 4/1975 | Schurger | 137/596.13 |
| 3,881,512 | 5/1975 | Wilke | 137/596.13 |
| 4,343,152 | 8/1982 | Habiger | 137/596.13 X |
| 4,515,181 | 5/1985 | Dezelan | 137/596.13 X |
| 4,548,239 | 10/1985 | Eskildsen | 137/596.13 X |

*Primary Examiner*—Gerald A. Michalsky

*Attorney, Agent, or Firm*—Remy J. VanOphem

[57] ABSTRACT

A proportional hydraulic distributor with a hollow, cylindrical compensating slide, a seat at one end of the compensating slide, a reciprocable piston, an end of which is urged against the seat by a spring, a pressure assistance chamber surrounding the seat, and a choke connecting the entry pressure of the hydraulic distributor to the pressure assistance chamber. The balance of forces on the reciprocable piston and on the cylindrical compensating slide is equal to and oppositely directed with respect to the hydrodynamic drag force that develops during transitional phases of the operation of the hydraulic distributor.

2 Claims, 3 Drawing Figures

ASSISTED SLIDE FOR PRESSURE COMPENSATION IN A HYDRAULIC DISTRIBUTOR

BACKGROUND OF THE INVENTION

This invention relates to an hydraulic distributor of the kind used in hydraulic systems for controlling, for example, hydraulic motors or jacks.

Such an hydraulic distributor has a distributing slide that is movable through several positions. This distributor is described as the proportional type when, for a given displacement of the slide, a given constant output is obtained in the operating circuits independent of the conditions of force or couple encountered by the receiver, jack, or similar equipment. Such a proportional hydraulic distributor is disclosed, for example, in the application for French Pat. No. 84 06 747, made by the present Applicant on the 18th Apr., 1984 under the title: "Hydraulic Distributor of the Proportional Type with Sensing of the Highest Pressures in the Operating Circuits." U.S. patent application Ser. No. 724,523 corresponds to such application for French patent. Besides the main distributing slide, an hydraulic distributor according to the present invention includes a pressure compensating slide which moves against a compression spring in a bore provided with annular operating channels, each one is connected to various branches of the hydraulic circuit.

In practice, it will be seen that, even if the position of the compensating slide is established at any moment in time by an equilibrium between the return force of the spring and the forces due to pressures which are applied to it at each of its ends, parasitic phenomena occur in dynamic operation which harm the stability of the control. These parasitic phenomena are due essentially to the appearance of a force of hydrodynamic drag, which is connected with the instantaneous characteristics of the flow, and which acts on the compensating slide with an intensity proportional to the variation in the quantity of movement between the upflow and downflow portions of the flow within the slide.

SUMMARY OF THE INVENTION

The present invention has the object of avoiding the stability disadvantages of a prior art hydraulic distributor that has a compensating slide by automatically creating, through a system of assistance, a force that is equal and in opposite direction to the force of hydrodynamic drag, so that the latter has no influence on the instantaneous position of equilibrium of the compensating slide.

A compensating slide for an hydraulic distributor according to the present invention has a cylindrical body sliding in a bore in the stator along which are placed distribution grooves. In such an hydraulic distributor the cylindrical body is hollow, and it has drilled apertures in it which slide with it opposite the distribution grooves to place the distribution grooves as required in communication with its internal space. The internal space of the cylindrical body opens at one end on a seat which is provided in the body of the slide, and on which the end of a blocking piston can come to bear. The blocking piston has a return spring which tends to press against the seat, the seat also being surrounded by an assistance chamber in the stator. According to another feature of the invention, the stator chamber surrounds the front end of the compensating piston, and the central port of the piston slides in a bore in the stator and forms a seal therein, while the rear part of the piston is surrounded by a chamber in which the pressure is in permanent communication with the operating pressure of the slide.

According to another feature of the invention, one of the stator grooves is connected to the input pressure, and it communicates with the assistance chamber through a choke.

BRIEF DESCRIPTION OF THE DRAWINGS

The attached drawings, given by way of non-limiting example, will allow the features of the invention to be better understood.

DETAILED DESCRIPTION OF THE PREFERRED EMBODIMENT

Figure 1:
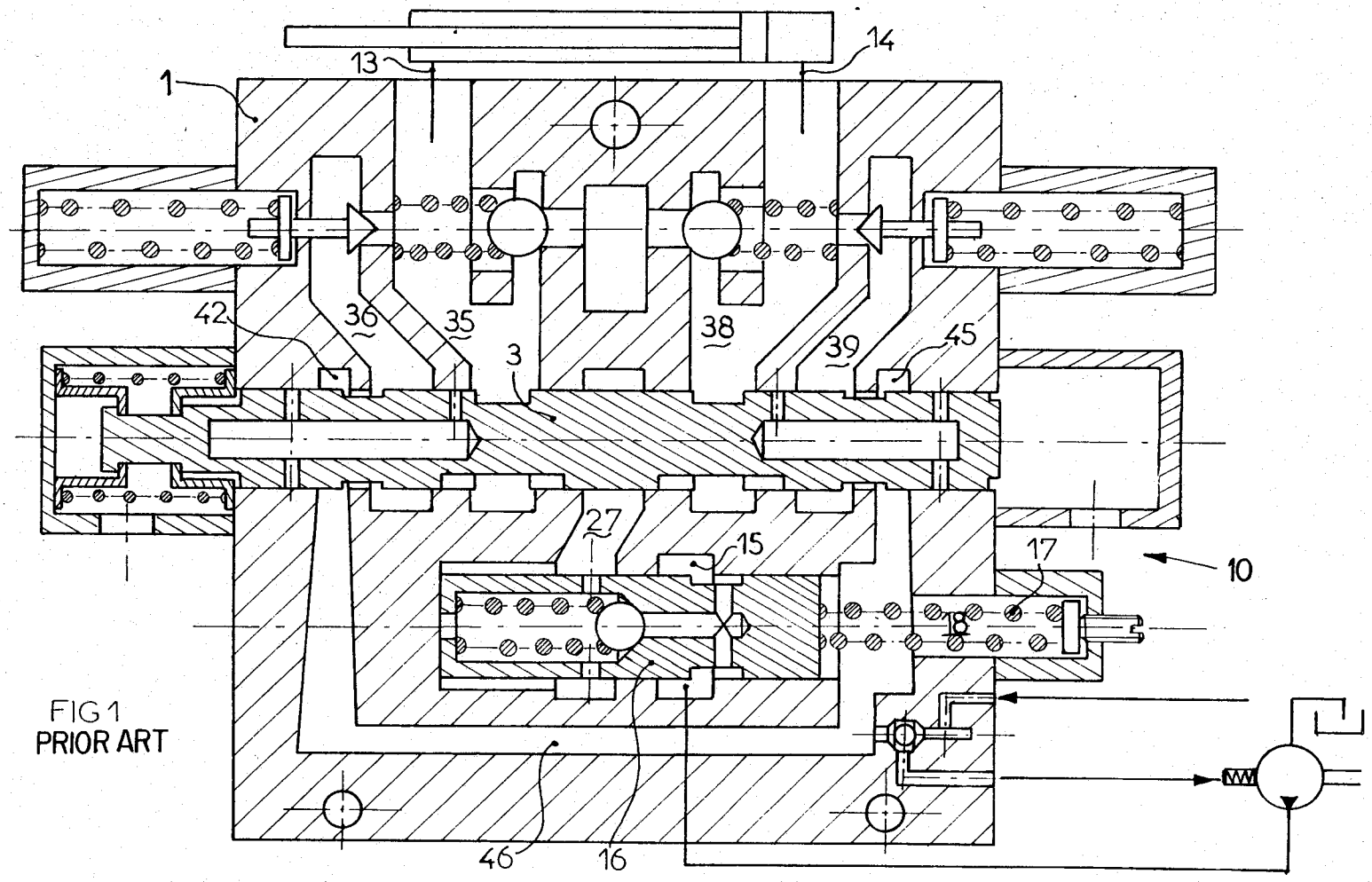
FIG 1 PRIOR ART
FIG. 1 is a diagrammatic sectional view showing the assembly of a proportional hydraulic distributor of the known type.

There is shown in FIG. 1 a proportional hydraulic distributor, identified generally by reference numeral 10, of the type disclosed by the application for a French Pat. No. 84 06 747 made in the name of the present Applicant on the Apr. 18th 1984 under the title: "Hydraulic Distributor of the Proportional Type with Sensing of the Highest Pressures in the Operating Circuits," corresponding to U.S. patent application Ser. No. 724,523.

The proportional hydraulic distributor 10 has a stator 1 and a main distributing slide 3 which is movable within the stator 1. The stator 1 includes a groove 35 which communicates with a first operating channel 13, a groove 36 which communicates with the return circuit, a groove 38 which communicates with a second operating channel 14 and a groove 39 which is connected to the return circuit. The main distributing slide is movable within the stator 1 across the grooves 35, 36, 38 and 39.

An annular chamber 27 surrounds the central port of the distributing slide 3. Two annular chambers 42 and 45 in the stator 1, located at the ends of the main distributing slide 3, are connected by a channel 46 for the detection of the operating pressure. The channel 46 communicates permanently with a chamber 18 in a spring 17 that is provided to return a compensating slide 16.

Figure 2:
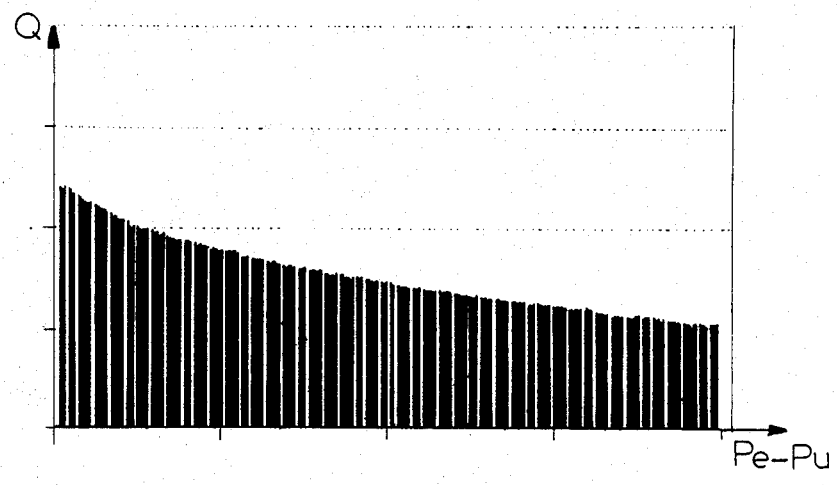
FIG. 2 is a graph showing the result of the strength of the hydrodynamic drag on the quality of regulation of the output of an apparatus with a pressure compensator.

Experience shows that in the dynamic phase of the operation of the proportional hydraulic distributor 10, that is to say during the phases when the compensating slide 16 is in movement, the movement of the compensating slide 16 is influenced by the force of hydrodynamic drag, which harms the quality of the control of the output of the proportional hydraulic distributor. In particular, if the variations in the hydraulic output Q as a function of the difference Pe-Pu, where Pe is the entry pressure, and Pu is the pressure upflow of a choke in the section of the main distributing slide, are traced on a diagram, the results shown in FIG. 2 are obtained. It will be seen that the output Q, instead of remaining constant, decreases as the value Pe-Pu increases.

Figure 3:
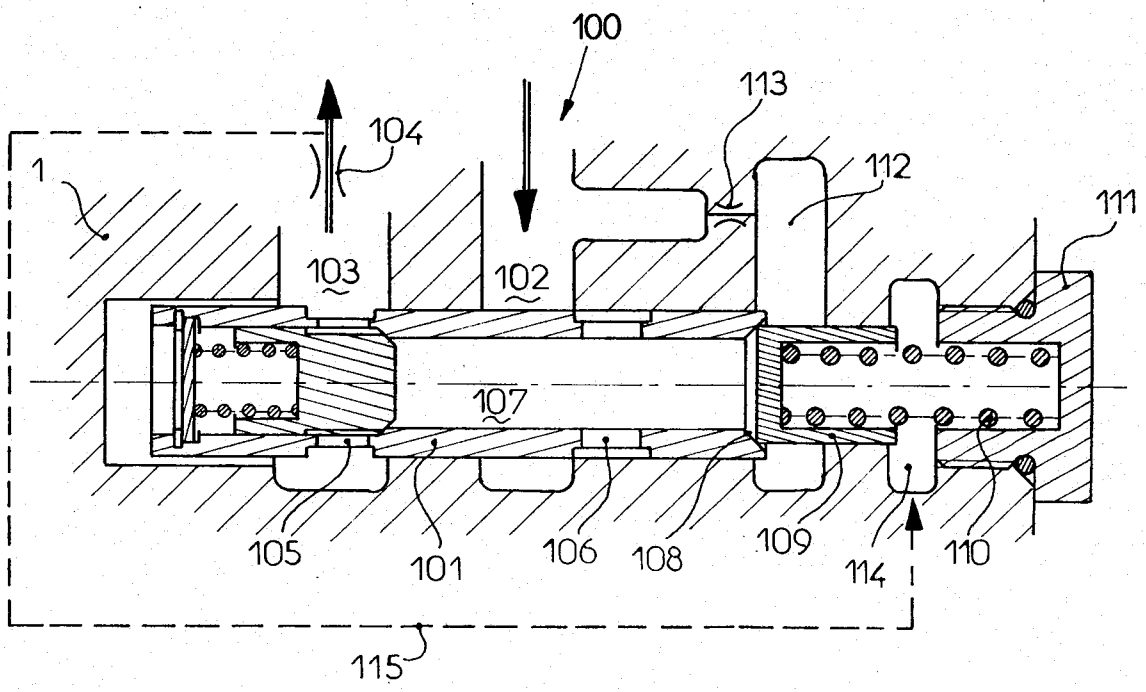
FIG. 3 is a view of a portion of the proportional hydraulic distributor of FIG. 1 which has been modified according to the preferred embodiment of the present invention.

The present invention is intended to avoid the decrease in output Q as the value Pe-Pu increases, and it does so by replacing the compensating slide 16 in FIG. 1 by the construction illustrated in FIG. 3, in which the effects of the force of hydrodynamic drag are automatically compensated and cancelled.

As illustrated in FIG. 3, the compensating slide according to the invention is identified generally by reference numeral 100 and has a hollow tubular body 101 sliding in the stator 1 opposite the grooves 102 (in which the entry pressure Pe is present) and 103 (in which the pressure Pu is present upflow of an operating choke 104). Drilled holes 105 and 106 extend through the wall of the tubular body 101 to open into an internal space 107. The tubular body 101 carriers a tapered seat 108 at one of its ends, and the front end of a sliding piston 109 can come to bear on the tapered seat 108 under the return thrust of a spring 110, which also bears against a plug 111 fixed in the stator 1.

At the front end of the sliding piston 109, near to the tapered seat 108, the hollow tubular body 101 of the compensating slide 100 is surrounded by an assistance chamber 112, in which a pressure Pas is present. The assistance chamber 112 communicates with the groove 102 through a choke 113. The pressure Pas located downflow of the choke 113 may, therefore, differ from the pressure Pe in the groove 102.

The operation of the hydraulic distributor of the present invention is as follows:

When the hollow tubular body 101 of the compensating slide 100 moves in the stator 1 in front of the grooves 102 and 103, it allows the fluid to pass through the internal space 107 to continue towards the operating choke 104 which controls the output, as shown by the arrows. The external diameter of the sliding piston 109 bears against the tapered seat 108 in the hollow tubular body 101. The sliding piston 109 is thrust against the tapered seat of the hollow tubular body 101 by the spring 110. The assistance chamber 112 is fed from the pressure in the groove 102 through the choke 113.

When the sliding piston 109 bears on the tapered seat of the hollow tubular body 101, it interrupts the connection between the assistance chamber 112 and the pressure Pu in the groove 103 and in the internal space 107. The pressure in the assistance chamber 112 can then increase, and approach the value Pe in the groove 102, but its increase will be limited when it gives rise to a force equal and opposite to that of the force of the hydrodynamic drag on the annular section formed between the body of the hollow tubular body 101 and the sliding piston 109. Thus, the assistance pressure is a function of the force of the hydrodynamic drag. The automatic operation is obtained as a result of the laws which govern the balance of force on the sliding piston 109 and the hollow tubular body 101 which functions as a slide member in the compensating slide 100. In fact, the position of the sliding piston 109 is determined by the difference in pressure, Pu-Pui, the pressure Pui representing the pressure downflow of the operating choke 104.

If the difference in pressure, Pu-Pui, increases, the sliding piston 109 moves compressing the spring 110; the hollow tubular body 101 of the compensating slide 100 follows the sliding piston 109 and reduces the connection between the grooves 102 and 103. Because of this, the movement of the hollow tubular body 101 causes a reduction of pressure in the groove 103, so that the sliding piston 109 assumes a new position of balance.

If the difference in pressure Pu-Pui decreases, the sliding piston 109 is pressed by the spring 110 against the hollow tubular body 101 of the compensating slide 100, which moves and increases the connection between the grooves 102 and 103. Because of this, the pressure Pu increases, and the sliding piston 109 assumes another new position of balance.

According to another feature of the present invention, the rear of the sliding piston 109 as well as the spring 110 is surrounded by a chamber 114 and a channel 115 keeps the chamber 114 connected to the hydraulic circuit downflow of the operating choke 104 where the pressure Pui obtains.

Although the best mode contemplated by the inventor for carrying out the present invention as of the filing date hereof has been shown and described herein, it will be apparent to those skilled in the art that suitable modifications, variations and equivalents may be made without departing from the scope of the invention, such scope being limited solely by the terms of the following claims.

What is claimed is:

1. A proportional hydraulic distributor for placement in a hydraulic system between an inlet having an entry pressure and an outlet having an exit pressure, said proportional hydraulic distributor comprising:

a stator having first and second bores therein, passage means for providing selective fluid communication between said first and second bores and first and second spaced apart distribution grooves in said second bore, one of said first and second distribution grooves being connected to the entry pressure;

a slide in said first bore that is slidable therein;

a compensating slide that is slidable in said second bore in said stator, said compensating slide being in the form of a cylindrical body with an open interior and having first and second apertures extending through said cylindrical body and communicating with said open interior, said cylindrical body further having first and second ends, one of said first and second ends having a seat;

a reciprocable piston having an end, said end of said reciprocable piston being adapted to contact said seat of said compensating slide;

a spring urging said reciprocable piston toward said compensating slide and tending to maintain said end of said reciprocable piston in contact with said seat;

a pressure assistance chamber in said stator surrounding said seat; and a choke, said one of said first and second distribution grooves being connected to said pressure assistance chamber through said choke.

2. A proportional hydraulic distributor according to claim 1 wherein said pressure assistance chamber further surrounds said end of said reciprocable piston, said piston further having a central part which forms a seal in said second bore in said stator and a second end, and further comprising:

a second choke, said second choke being exposed to the exit pressure, the pressure downflow of said second choke being the operating pressure of said proportional hydraulic distributor; and an output pressure chamber in said stator, said output pressure chamber surrounding said second end of said reciprocable piston and being exposed to said operating pressure of said proportional hydraulic distributor.

* * * * *